US009733040B2

(12) United States Patent
Roady et al.

(10) Patent No.: US 9,733,040 B2
(45) Date of Patent: Aug. 15, 2017

(54) FULLY ADJUSTABLE TELESCOPIC ARCHERY STABILIZER AND INTEGRATED OPTICAL SUPPORT DEVICE

(71) Applicants: Amos Roady, Albuquerque, NM (US); Micah Brown, Auburn, CA (US)

(72) Inventors: Amos Roady, Albuquerque, NM (US); Micah Brown, Auburn, CA (US)

( * ) Notice: Subject to any disclaimer, the term of this patent is extended or adjusted under 35 U.S.C. 154(b) by 0 days.

(21) Appl. No.: 14/988,366

(22) Filed: Jan. 5, 2016

(65) Prior Publication Data

US 2016/0195356 A1 Jul. 7, 2016

Related U.S. Application Data

(60) Provisional application No. 62/099,770, filed on Jan. 5, 2015, provisional application No. 62/217,171, filed on Sep. 11, 2015.

(51) Int. Cl.
*F41B 5/20* (2006.01)
*F41B 5/14* (2006.01)

(52) U.S. Cl.
CPC ..... *F41B 5/1426* (2013.01); *F41B 5/14* (2013.01)

(58) Field of Classification Search
CPC ..... F16M 11/28; F41B 5/14; F41B 5/1426; F41G 1/467
See application file for complete search history.

(56) References Cited

U.S. PATENT DOCUMENTS

| | | | | |
|---|---|---|---|---|
| 5,320,085 | A * | 6/1994 | Hanneman | F41B 5/1426 124/86 |
| 5,370,104 | A | 12/1994 | Neie | |
| 5,975,070 | A | 11/1999 | Sands | |
| 6,142,698 | A * | 11/2000 | Nutter | F16B 7/0426 403/104 |
| 6,186,135 | B1 | 2/2001 | Harwath et al. | |
| 6,718,964 | B1 | 4/2004 | Graf | |
| 6,997,174 | B2 | 2/2006 | Sandberg | |
| 8,006,682 | B2 * | 8/2011 | Vanek | F41B 5/066 124/25.5 |
| 8,695,581 | B2 | 4/2014 | Felt et al. | |
| 8,939,140 | B2 | 1/2015 | Mancini | |
| 2005/0072414 | A1 * | 4/2005 | Bryant | F41B 5/1426 124/24.1 |
| 2006/0283435 | A1 | 12/2006 | Pellerite | |
| 2012/0240913 | A1 | 9/2012 | Stokes | |

* cited by examiner

*Primary Examiner* — John Ricci
(74) *Attorney, Agent, or Firm* — Kevin Soules; Luis M. Ortiz; Kermit D. Lopez

(57) ABSTRACT

A stabilizer comprises at least two tubes, a first end cap comprising a fastening member formed on a proximal end of one of the at least two tubes wherein the end cap is formed to fixedly engage with a bow, a compression fitting for rigidly fixing the at least two tubes together, and a second end cap comprising a fastening member formed on a distal end of one of the at least two tubes wherein the second end cap is formed to fixedly engage with at least one weight.

14 Claims, 9 Drawing Sheets

FULLY ADJUSTABLE TELESCOPIC ARCHERY STABILIZER AND INTEGRATED OPTICAL SUPPORT DEVICE

CROSS REFERENCE TO RELATED APPLICATION

This patent application claims the priority and benefit under 35 U.S.C. §119(e) of U.S. Provisional Patent Application Ser. No. 62/099,770 filed Jan. 5, 2015, entitled "FULLY ADJUSTABLE TELESCOPIC ARCHERY STABILIZER." U.S. Provisional Patent Application Ser. No. 62/099,770 is herein incorporated by reference in its entirety. This patent application also claims the priority and benefit under 35 U.S.C. §119(e) of U.S. Provisional Patent Application Ser. No. 62/217,171 filed Sep. 11, 2015, titled "INTEGRATED OPTICAL SUPPORT DEVICE." U.S. Provisional Patent Application Ser. No. 62/217,171 is herein incorporated by reference in its entirety.

TECHNICAL FIELD

The present embodiments are generally related to systems, methods, and apparatuses for archery. The embodiments are further related to systems, methods, and apparatuses for stabilizing a bow. The embodiments more specifically relate to systems, methods, and apparatuses for a fully adjustable telescoping archery stabilizer that can be mounted on a bow.

The present embodiments also relate to systems, methods, and apparatuses for hunting. The embodiments are further related to systems, methods, and apparatuses for improving long-range vision. The embodiments provide systems, methods, and apparatuses for a mounting platform for stabilizing optics that can be integrated with other hunting equipment.

BACKGROUND

It is well known that an archer's accuracy can be improved using various stabilizing techniques. Among these is what is known in the art as a stabilizer. Stabilizers generally provide a counterbalance to the bow itself thereby improving the archer's ability to hold the bow steady.

However, the stabilizer art suffers from a number of problems. First, stabilizers are generally sold in pre-set lengths that cannot be adjusted. As a result archers are forced to purchase multiple stabilizers for different shooting applications. Similarly, stabilizers can be heavy, inconvenient, and expensive.

Additionally, nearly all serious hunters carry vision enhancing devices in the field. The most preferred device is binoculars. This is due largely to the fact that binoculars are relatively lightweight and can be easily transported. However, all such optical devices require that the user hold the optical device steady as they look through the device. This requires significant physical effort and limits the duration that most hunters can use the optical device.

Some solutions to this problem include tripods or other types of stands, which can hold the optical device. However, these types of solutions are often bulky, heavy, require time to step up and take down, and are inconvenient. As a result, most hunters choose not to use such devices and instead opt to carry binoculars without any support device Additionally, optical devices generally require the use of both of the user's hands. This means that the user may not be able to operate calling devices, archery equipment, shooting equipment, or other equipment, and the optical device at the same time.

Therefore, there is a need in the art for systems and apparatuses that provide a lightweight means for steadying a bow and that may serve as a platform for holding optical devices in the field as disclosed herein.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

The embodiments disclosed herein provide a fully adjustable, telescoping archery stabilizer. The telescoping archery stabilizer consists of a series of interconnected tubes. The proximal end of the arrangement includes an assembly for connecting the telescoping stabilizer to a bow. Each section of the tube is configured with locking means for holding, the respective sections of tube together. The distal end of the arrangement includes an assembly for adding or removing weights in order to adjust to the weight of the bow and selected length of the stabilizer.

The present embodiments further provide an integrated support device which can be mounted on a stabilizer, weapon, or other such structure, configured to hold an optical device such as binoculars.

It is therefore an aspect of the disclosed embodiments to provide a system, method, and apparatus for stabilization. For example, in an embodiment a stabilizer comprises at least two tubes, a first end cap comprising a fastening member formed on a proximal end of one of the at least two tubes wherein the end cap is formed to fixedly engage with a how, a compression fitting for rigidly fixing the at least two tubes together, and a second end cap comprising a fastening member formed on a distal end of one of the at least two tubes wherein the second end cap is formed to fixedly engage with at least one weight.

In another embodiment, the at least two tubes are further configured such that each of the tubes has a decreasing diameter such that a next of the at least two tubes can be positioned inside a previous of the at least two tubes. The compression fitting further comprises: a locking collar, a compression knuckle, and a compression member inside the compression knuckle wherein the compression knuckle can be engaged with the locking collar thereby compressing the compression member.

In another embodiment, the stabilizer further comprises a mounting platform configured to fixedly engage with the first end cap. The mounting platform further comprises at least one indent formed in the mounting platform and at least one threaded mounting stub wherein the mounting stub is configured to fixedly attach to the first end cap.

In another embodiment, the mounting platform further comprises at least one cutout formed in the indent formed in the mounting platform and at least one strap slot formed through a rim of the mounting platform. In another embodiment, the mounting platform further comprises at least one strap wherein the strap is configured to hold an optical device on the mounting platform.

In another embodiment, the optical device comprises one of binoculars, a scope, a spotting scope, a telescope, and a range finder.

BRIEF DESCRIPTION OF THE DRAWINGS

The accompanying figures, in which like reference numerals refer to identical or functionally similar elements throughout the separate views and are incorporated in and form a part of the specification, further illustrate aspects of the embodiments and, together with the background, brief summary, and detailed description, serve to explain the principles of the embodiments.

DETAILED DESCRIPTION

Figure 1:
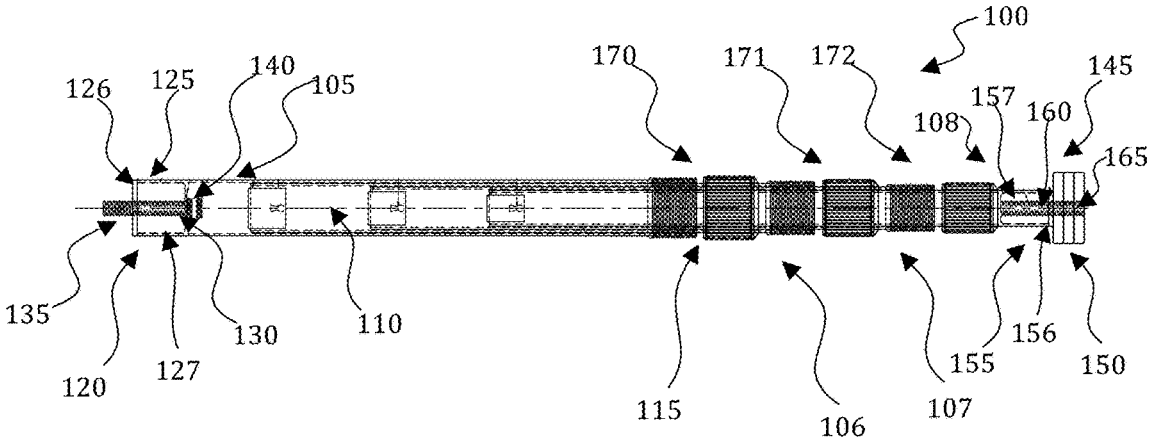
FIG. 1 illustrates a stabilizer in accordance with an embodiment disclosed herein.

The following description contains a series of exemplary embodiments of systems, methods, and apparatuses for integrated bow stabilizers and optical mounting devices not previously known.

The exemplary embodiments described more fully hereinafter make reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The particular values and configurations discussed in the following non-limiting examples can be varied and are cited merely to illustrate one or more embodiments and are not intended to limit the scope thereof.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence, or addition, of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or" as used herein may include a variety of meanings that may depend at, least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense, or may be used to describe combinations of features, structures, or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In one embodiment, an adjustable telescoping archery stabilizer 100 is shown. As illustrated in FIG. 1, the telescoping stabilizer 100 comprises tubes (or tube sections) 105, 106, 107, and 108. It should be appreciated that any number of tubes may be equivalently utilized. For example, the assembly may include one, two, three, four, five, or more tubes.

The tubes are preferably hollow, uni-directional, or formed from a uni-directional material, and include at least one, and preferably two or more, integrated protruding groove channels 110. The diameter of tube 108 is slightly smaller than the diameter of tube 107, which is smaller than the diameter of tube 106, which is smaller than the diameter of tube 105. Generally, the diameters of the respective sections of tube (such as sections 105, 106, 107, and 108) decrease as the apparatus is extended in order to provide telescoping function.

Tubes 105, 106, 107, and 108 can be formed of carbon fiber, uni-directional carbon fiber, steel aluminum, plastic, rubber, or other such material, according to design considerations. Carbon fiber, and in particular uni-directional carbon fiber is preferable because of its superior strength to weight ratio and lateral strength along the length of the tubes 105, 106, 107, and 108. The tubes 105, 106, 107, and 108 may be colored black, camouflage, some combination thereof or in any other color depending on design considerations.

Tube 105 is the section of tube proximate to the bow, and may be fitted on one end with a multi-directional locking apparatus 115 and on the other end with an assembly 120 to connect the stabilizer to the bow. The assembly 120 to connect the stabilizer to the bow can comprise a threaded end cap fitting 125.

The threaded end cap fitting 125 is preferably formed from aluminum which is lightweight and strong, but may alternatively be made of other materials. The threaded end cap fitting 125 is fixedly attached to the tube 105. In a preferred embodiment, the end cap fitting 125 includes a larger diameter cap which forms a lip 126 that fits flush with the outer diameter of tube 105 and a cup 127 which extends in, and fits within, the inner diameter of the wall of tube 105. The threaded end cap fitting 125 thus resembles the shape of a top hat.

The threaded end cap fitting 125 can preferably be bonded to the tube 105 with Hysol 9340, which is a two part compound comprising epoxy and hardener. Alternative bonding materials or methods may alternatively be used, or the threaded end cap may be held in place using alternative means such as set screws, glue, clips, etc. The threaded end cap fitting 125 may be formed with horizontal grooves to improve adhesion between the threaded end cap fitting 125 and the tube 105. The end cap fitting 125 may also have vertical grooves configured to fit with groove channels 110 formed on tube 105.

A female threaded receiving bore 130 extends through the cup 127 and threaded end cap fitting 125. A cap head screw 135 can be driven from the inside of tube 105 through the receiving bore 130 in the threaded end cap fitting 125 so that the threads of the cap head screw 135 extend out of the end of the threaded end cap fitting 125. A locking washer 140 can be used between the head of the cap head screw 135 and the outer surface of the cup 127 in order to hold the cap head screw 135 firmly in place. In a preferred embodiment, the cap head screw 135 is formed of hardened alloy steel, but may alternatively be formed of other known materials.

The threaded receiving bore 130 and cap head screw 135 are preferably 5/16-24. This is the industry standard size for receiving bores on bows, and more specifically, on bow risers. However, it should be appreciated that the threaded receiving bore 130 and cap head screw 135 may be formed with any thread size and at any length as required for any particular application. The protruding threaded section of head cap screw 135 can thus be screwed into a receiving bore on a bow.

Tube 108 is the section of tube furthest from the bow and may be fitted with an assembly 145 to connect weights 150 to the most distal end of the section 108. The assembly 145 to connect weights 150 to the distal end of tube 108 differs only slightly from threaded end cap fitting 125 used at the end of tube 105.

The assembly 145 includes a threaded aluminum end cap fitting 155 similar to the threaded end cap fitting 125 described with respect to tube 105 except that the diameter of the cap is formed with a lip 156 which fits flush with the outer diameter of tube 108 and the cup 157 extends in, and fits within, the inner diameter of the wall of tube 108. The threaded end cap fitting 155 thus also resembles the shape of a top hat.

The threaded end cap fitting 155 can also preferably be bonded to the carbon fiber tube 108 with Hysol 9340, which is a two part compound comprising epoxy and hardener. Alternative bonding materials or methods may alternatively be used, or the threaded end cap fitting 155 may be held in place using alternative means such as set screws, glue, clips, etc. The threaded end cap fitting 155 may be formed with horizontal grooves to improve adhesion between the threaded end cap fitting 155 and the tube 108. The threaded end cap fitting 125 may also have vertical grooves configured to fit with groove channels 110 formed on tube 108.

A female threaded receiving bore 160 extends through the cup 157 and threaded end cap fitting 155. A weight screw 165 can be driven from the inside of tube 108 through the receiving bore 160 in the threaded end cap fitting 155 so that the threads of the weight screw 165 extend out of the end of the threaded end cap fitting 155. A portion of the weight screw 165 extends out of the end of the threaded end cap fitting 155. The length of the weight screw 165 that extends out of the end of the threaded end cap fitting 155 can be adjusted to accommodate a varying number of weights 150. In a preferred embodiment the weight screw 165 is formed of hardened alloy steel, but may alternatively be formed of other known materials.

The threaded receiving bore 160 and the weight screw 165 are preferably 5/16-24. It should be appreciated that the threaded receiving bore 160 and the weight screw 165 may be formed with any thread size as required for any particular application. The protruding threaded section of the weight screw 165 is formed to receive one or more weights 150.

Figure 3:
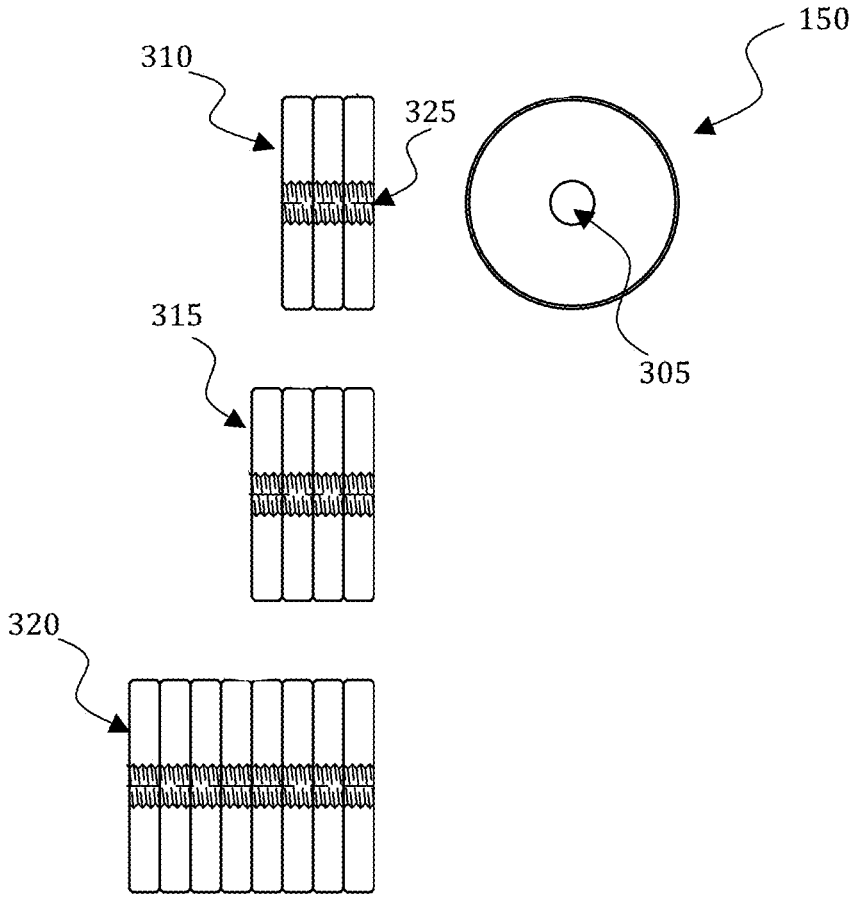
FIG. 3 illustrates weights for use with a stabilizer in accordance with an embodiment disclosed herein.

Weights 150 are further detailed in FIG. 3. As illustrated in FIG. 3, weights 150 are formed as discs or other such shapes with female threads 325 in female threaded bores 305 in the center of the weight 105. In a preferred embodiment, the weights 150 are cnc machined brass weights. In alternative embodiments, the weights 150 may be formed of aluminum, lead, steel, copper, plastic, rubber, or other suitable materials. The weights 150 may be colored black, camouflage in any other color depending on design considerations. As illustrated in FIG. 3, the weights 150 may be organized in weight stacks 310, 315, and/or 320 wherein the weight stacks may include any number of weights 150. It should be understood that the weight screw 165 must sufficiently protrude from the threaded end cap fitting to provide sufficient space for the desired weight stack 310, 315, and/or 320.

Each of tube sections 105, 106, 107, and 108 are formed with a multi-directional locking system, which comprises compression fitting assemblies 170, 171, and 172 respectively, so that each of the respective tubes 105, 106, 107, and 108 can be slid into place and then locked in that position. This provides the ability to dynamically adjust the length of the stabilizer 100 to account for the archer's specific situation.

For example, in a hunting situation, the total length of the stabilizer 100 may be decreased in order to improve the hunters concealment and because the archer is only likely to shoot at relatively close targets. By contrast, in a target shooting or competition application, the total length of the stabilizer 100 may be increased as the archer's target is likely to be farther away and concealment is not an issue. Further, the total length of the stabilizer 100 may be adjusted when used on multiple bows to account for the varying weight of each bow, or by multiple archers in order to account for each archer's specific desired total length.

Figure 2:
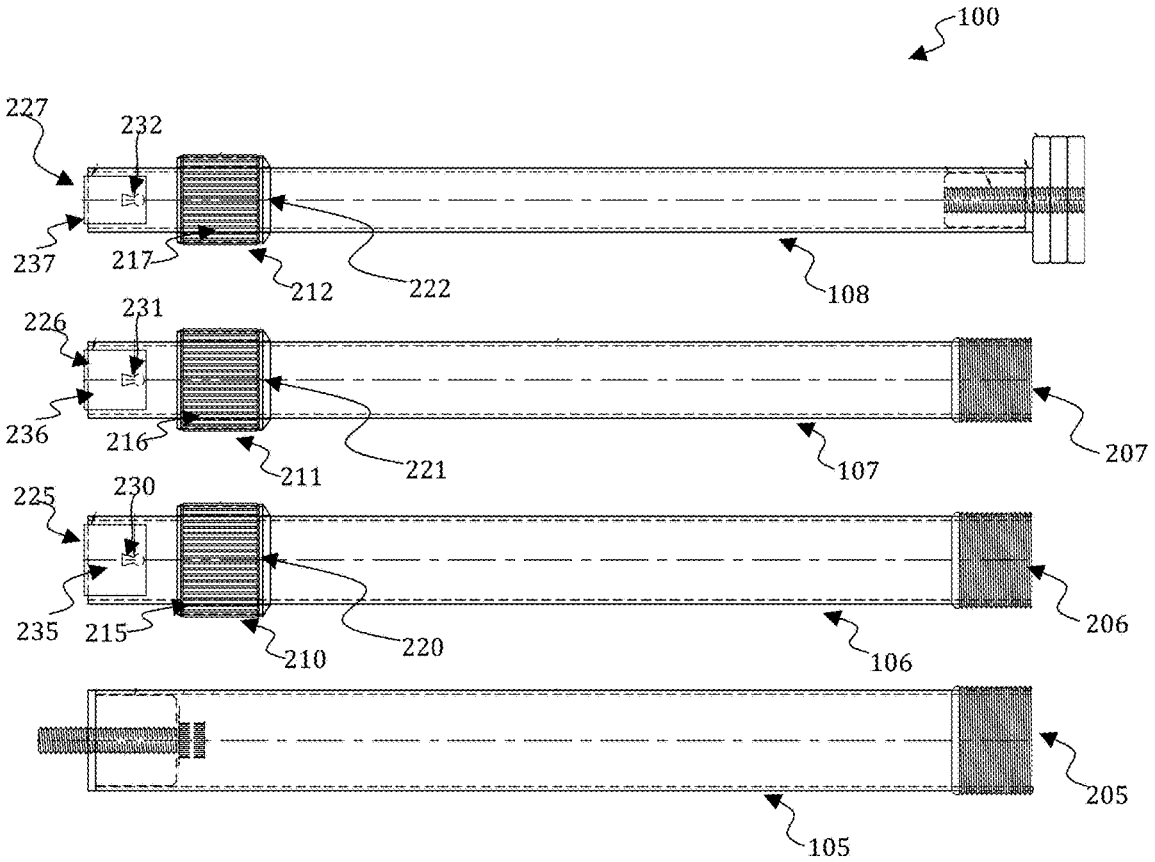
FIG. 2 illustrates sections of a stabilizer apparatus in accordance with an, embodiment disclosed herein.

FIG. 2. Illustrates each of tube sections 105, 106, 107, and 108 in separated segments. The compression fittings 170, 171, and 172 comprise three basic parts as shown in FIG. 2. The end of tube 105 includes a male threaded collar fitting 205, the end of tube 106 includes a male threaded collar fitting 206, and the end of tube 107 includes a male threaded collar fitting 207. The diameter of the collar fittings 205, 206, and 207 is varied for each of tubes 105, 106, and 107 so that the collar fittings 205, 206, and 207 for each respective tube 105, 106, and 107 fits snugly on the end of the tube. The collar fittings 205, 206, and 207 can be bonded to the end of each of respective tubes 105, 106, and 107. The collar fittings 205, 206, and 207 are preferably formed from aluminum, but may alternatively be made of any suitable material such as steel, plastic, carbon, etc.

The compression fittings 170, 171, and 172 also include female threaded knuckles 210, 211, and 212. The knuckles 210, 211, and 212 are formed with grooved rubber grips 215, 216, and 217 that slide over the knuckles 210, 211, and 212, respectively. The rubber grips 215, 216, and 217 provide a graspable surface for manipulating the knuckles 210, 211, and 212.

Referring to FIGS. 1 and 2, it should be understood that the knuckles 210, 211, and 212 are formed to slide along tubes 106, 107, and/or 108, respectively, but are further formed to attach with the collar fitting 205, 206, and 207, respectively. For example, knuckle 210 is configured to slide along tube 106 and attach to collar fitting 206. Knuckle 211 is configured to slide along tube 107 and attach to collar fitting 207. Knuckle 212 is configured to slide along tube 108 and attach to collar fitting.

Thus, tube 145 includes collar fitting 205. The knuckle 210 shown on tube 106 can slide along tube 106, and the diameter of tube 106 allows tube 106 to slide inside tube 105 to a desired length. Once tube 106 has been slid into the desired position inside tube 105, knuckle 210 on tube 106 can be connected with collar fitting 205 on tube 105. When knuckle 210 is spun down and tightened around collar fitting 205, a compression member 220 attached to the inside of knuckle 210 is compressed. The compression of the compression member 220 holds tube 106 at the desired position in tube 105. Similarly, the compression fitting 171 between tube 106 and tube 107 comprises the similar, although different sized collar fitting 206, knuckle 211, and compression member 221, operating in the manner described above. Likewise, the compression fitting 172 between tube 107 and tube 108 comprises the similar, although different sized collar fitting 207, knuckle 212, and compression member 222, operating in the manner described above. It should be understood that with the addition of additional tubes, the total length of the stabilizer can be increased and that additional compression fittings are required for each additional tube.

FIG. 2 illustrates that each of tubes 106, 107, and 108 includes a multi directional locking piece 225, 226, and 227, respectively, at the end opposite the compression fitting. Each of tubes 106, 107, and 108 are formed with a hole 230, 231, and 232, respectively formed in the end of the tube with the multi directional locking piece. The holes 230, 231, and 232 are preferably keyhole shaped, but may be formed as a circle, square, rectangle, triangle, star, or other such appropriate shape.

Each multi directional locking piece 225, 226, and 227 is formed with a molded insert 235, 236, and 237, respectively, which is shaped to match the hole 230, 231, or 232 formed in the tube. The locking piece 225, 226, and 227 can thus be installed on the end of the tube with the molded insert inserted into the hole 230, 231, or 232 to hold the locking piece 225, 226, or 227 in place. Additionally, the ends of tubes 106, 107, and 108 include an integrated groove in the tube. The locking piece 225, 226, and 227 can have a channel that fits with the integrated groove to prevent the locking piece 1 from twisting. In a preferred embodiment, the locking pieces 225, 226, and 227 are formed of hard plastic but could be formed of other acceptable materials depending on design considerations. It should be appreciated that other locking mechanisms may alternatively be used.

The stabilizer 100 may further be formed with an internal vibration dampening system. This may include any number of known means for reducing the vibration transmitted through the stabilizer when the bow is drawn and released. The internal vibration dampening system can be a collapsible assembly fitted along the tubes or could be a fitted piece configured in the distal end of the tubes.

Figure 4:
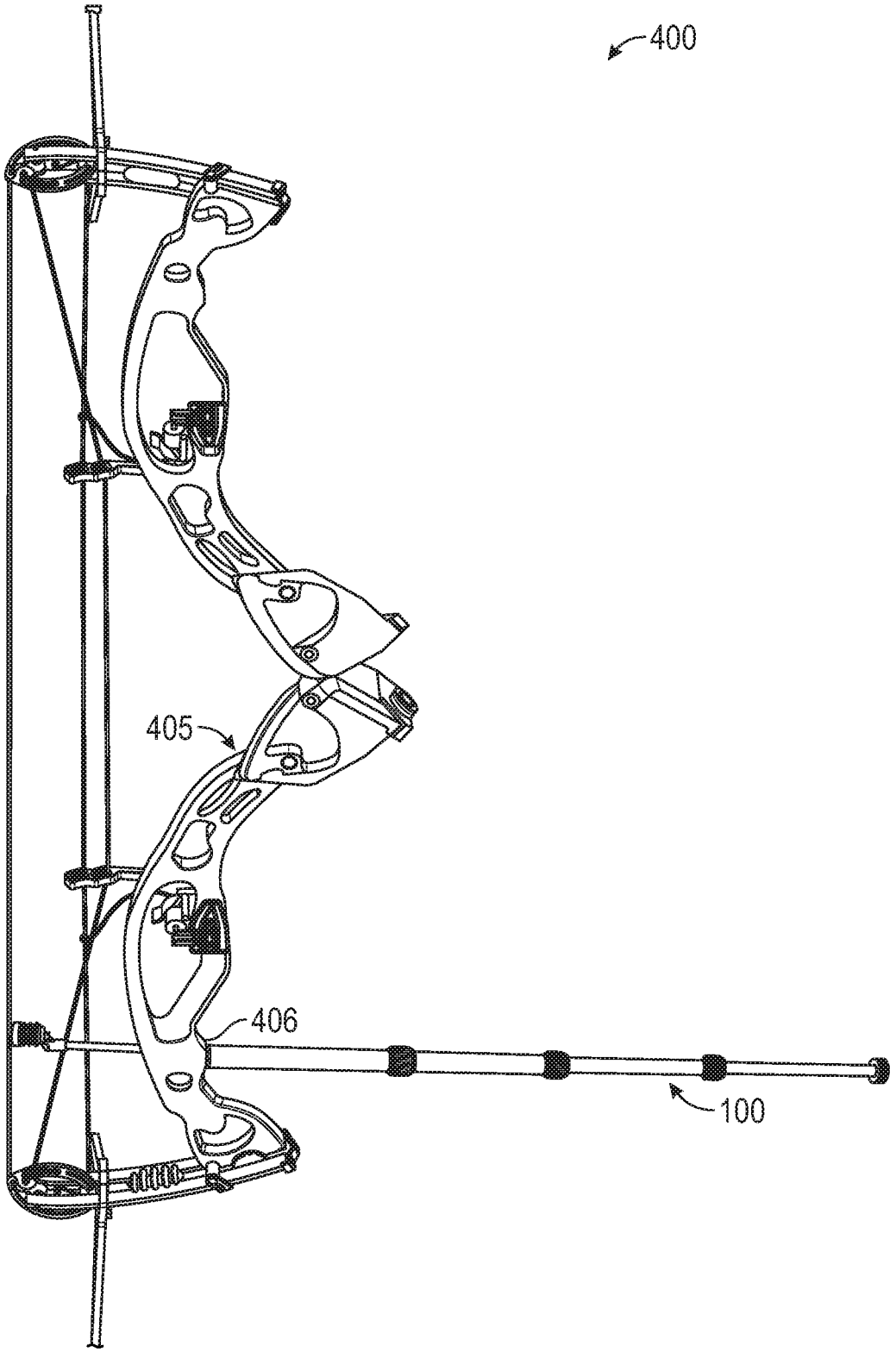
FIG. 4 illustrates an image of a stabilizer attached to a bow in accordance with an embodiment disclosed herein.

The stabilizer 100 is thus configured as an adjustable telescoping stabilizer wherein tube 108 can be slid inside tube 107, tube 107 can be slid inside tube 106, and tube 106 can be slid inside tube 105 to adjust the total length of the stabilizer 100. Once the desired length of tube 108 is selected, the knuckle 212 on tube 106 can be engaged with locking collar 207 on tube 107. When the knuckle 212 is tightened on locking collar 207, tube 108 is rigidly fixed in place relative to tube 107. Similarly the desired length of tube 107 is selected with respect to tube 106, and the desired length of tube 106 is selected with respect to tube 105. The knuckle 211 on tube 107 can be engaged with locking collar 206 on tube 106. When the knuckle 211 is tightened on locking collar 206, tube 107 is rigidly fixed in place relative to tube 106. The knuckle 210 on tube 106 can be engaged with locking collar 205 on tube 105. When the knuckle 210 is tightened on locking collar 205, tube 106 is rigidly fixed in place relative to tube 105. The stabilizer 100 is thus adjusted to a desired total length. The stabilizer can then be engaged with a bow 405 or bow riser 405 on a bow 400 as shown in the image 400 of FIG. 4.

Figure 9:
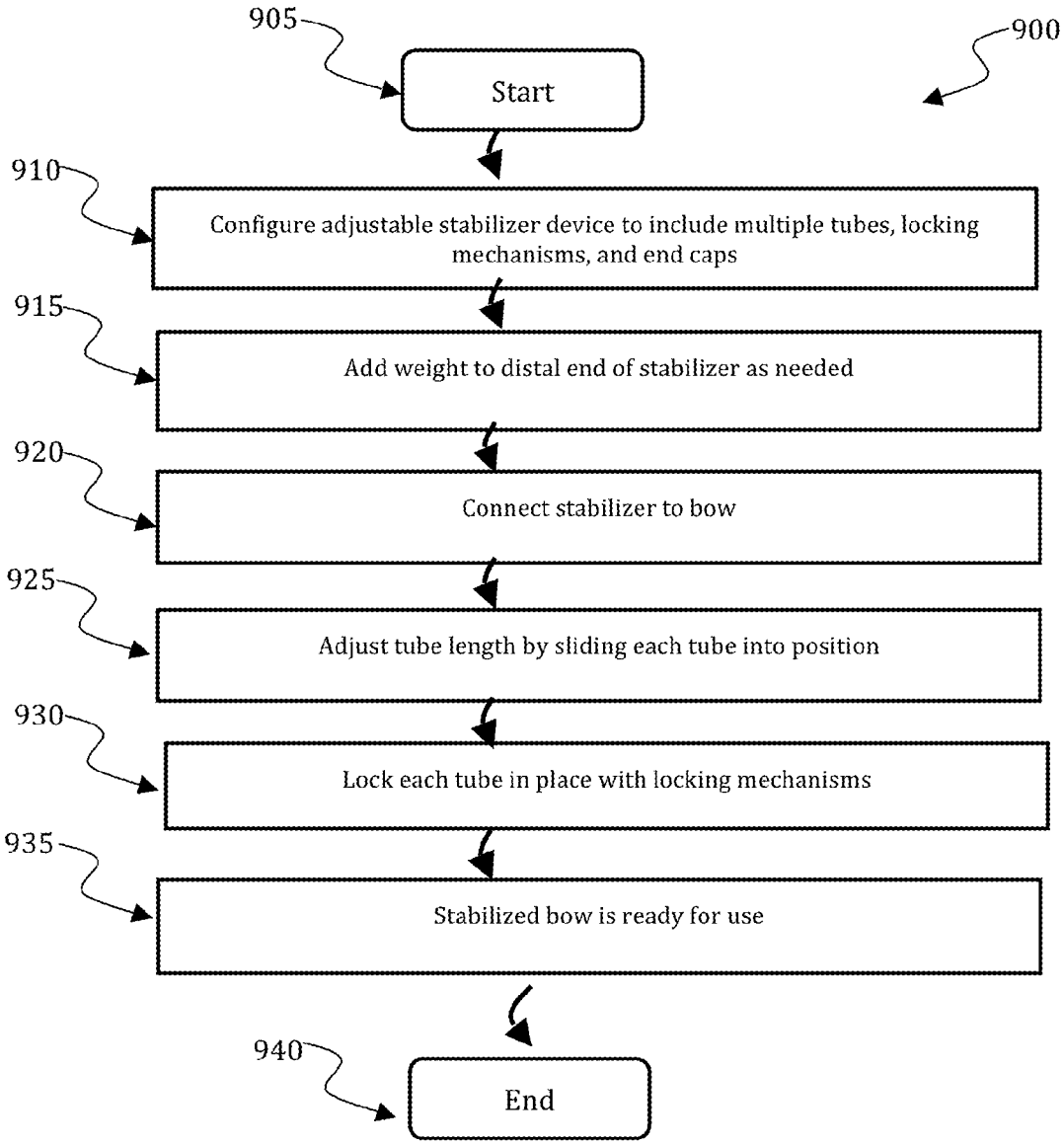
FIG. 9 illustrates a flow chart of steps associated with another method in accordance with an embodiment disclosed herein.

A set of steps associated with a method 900 for stabilizing a bow is illustrated in FIG. 9. The method begins at step 905. At step 910, a stabilizer can be configured to include multiple telescoping tubes, which are locked in place with locking mechanisms. The proximal end of the first tube includes an end cap which serves to connect the tubes to a bow or mounting platform. The distal end of the last tube also includes an end cap upon which weights can be mounted.

At step 915, weights may be added to the distal end of the telescoping stabilizer in order to provide a counter weight to the weight of the bow. The telescoping stabilizer can then be connected to a bow via a connection means on the end cap of the stabilizer at step 920. The desired total tube length can be determined. The tubes can be telescoped to the desired length by sliding the tubes inside one another until the preferred length is achieved as shown at step 925. At step 930, each of the tubes can then be locked in place with the locking mechanisms. It should be appreciated that the steps illustrated at steps 910-930 may alternatively be completed in a different order. The stabilizer is now installed on the bow and the bow is ready for use as shown at step 935. The method ends at step 940.

Figure 5:
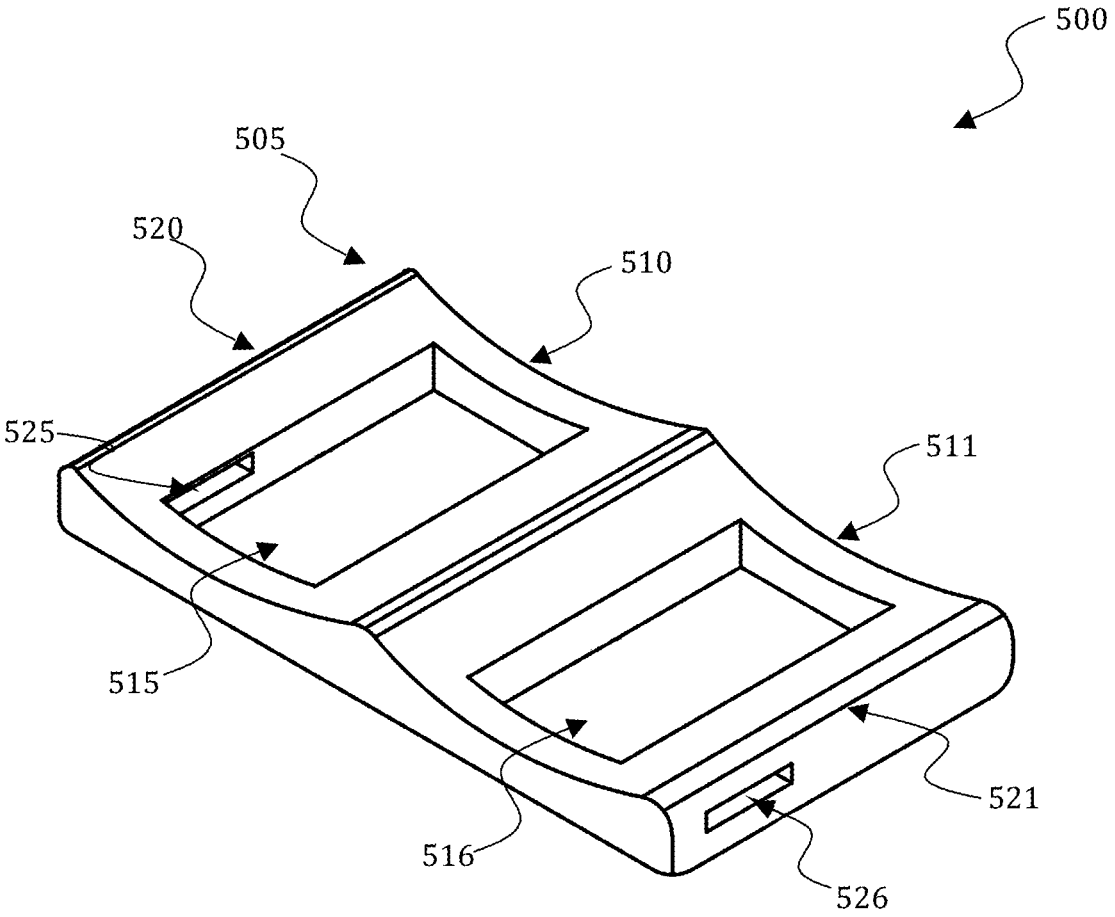
FIG. 5 illustrates an optical platform in accordance with an embodiment disclosed herein.

In one embodiment, the stabilizer 100 can be configured to further include an optical mounting system 500 configured to hold an optical device in the field. As illustrated in FIG. 5, the system 500 includes a mountable platform 505 comprised of two side-by-side indentations 510 and 511, which serve as rests for the optical tubes of, for example, a pair of binoculars. It should be appreciated that in other embodiments, the optical mounting system 500 may have only one indentation for use with a spotting scope, telescope, or other such monocular device. In yet another embodiment the single indentation may be formed in a direction perpendicular to the side-by-side indentations illustrated in FIG. 5, providing the ability to hold binoculars in one direction and single tube devices, such as spotting scopes, in the other.

Each of indentations 510 and 511 include a cut out portion 515 and 516 respectively, which are intended to reduce the total weight of the optical mounting system 500. A user in the field may travel a long distance under their own power. Thus, reducing the weight of the platform 500 via cutouts 515 and 516 is of critical importance. The shape of the cutouts 515 and 516, as illustrated in FIG. 5, is rectangular, but other shaped cutouts such as squares, triangles, ovals, or circles may also be used depending on design considerations. The shapes of such cutouts may be selected to match the contour of an optical device.

The mounting, platform 505 is preferably a lightweight hardened one piece (or molded) assembly. The mounting platform 505 can be formed or molded out of Delrin or other such type of lightweight, durable, hardened material. This may include carbon fiber, uni-directional carbon fiber, steel, aluminum, plastic, rubber, or other such material, according to design considerations. In order to reduce weight, the mounting platform 505 may be hollow tubing of such materials. The mounting platform 505 may be colored black, camouflage, or in any other color depending on design considerations.

All the edges of the mounting platform 505 can be rounded, or smoothed, so that the mounting platform 505 is easy to carry in a pocket or pack. The rounded edges such as edges 520 and 521 leave no sharp points or corners on the mounting platform 505 which might poke a user.

The mounting platform 505 further includes at least one and potentially many strap slots such as strap slots 525 and 526. The strap slots 525 and 526 are openings on the outer edges of the platform 505. The strap slots 525 and 526 allow a strap to be fed through, for example, strap slot 525. The strap can then be wrapped around and/or under the mounting platform 505 and back through the other strap slot 526. This allows an optical apparatus, such as a pair of Binoculars to be securely mounted in place on the mounting platform 505. It should be understood that the strap may be a strap associated with the optical device or it may be an independently included strap.

Figure 6:
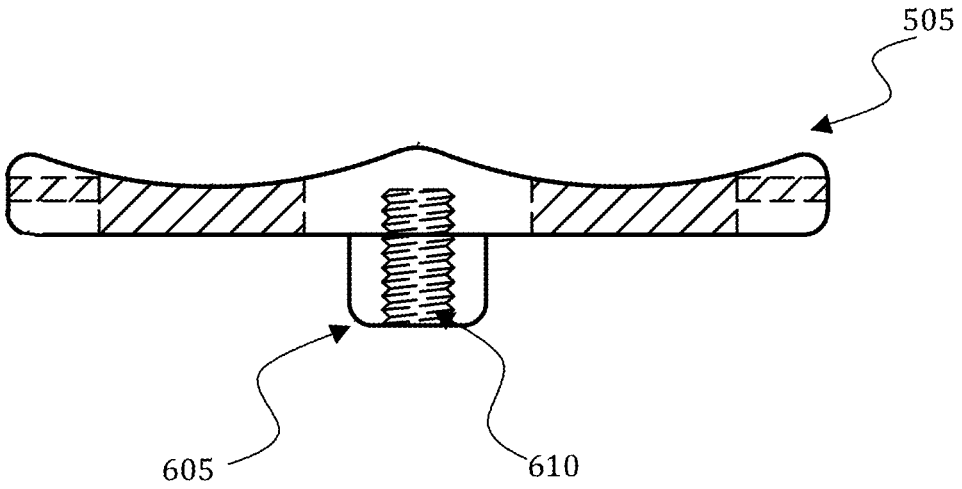
FIG. 6 illustrates a side view of an optical platform in accordance with an embodiment disclosed herein.

The mounting platform 505 includes a mounting stub 605 formed on the back side of the mounting platform 505, as shown in FIG. 6. A universal female threading member 610 is formed in the mounting stub 605. The female threaded member 610 may be 5/16-24, which is the industry standard size for receiving bores on bows, and more specifically, on bow risers. The size of the female threaded member is preferably selected to fixedly attach with cap head screw 135 or weight screw 165. However, it should be appreciated that the universal threading member 610 may be formed with any thread size and at any length as required for any particular application. The mounting stub 605 is shown as a square in the figures. However, other shaped mounting stubs are possible. For example, the mounting stub may be hex shaped or otherwise shaped to engage tightening tools if desired.

The universal threading member 610 may thus serve to attach the mounting platform 505 to a matching male bolt such as cap head screw 135 or weight screw 165. In a preferred embodiment, the cap head screw 135, or weight screw 165, may be formed on a stabilization device such stabilizer 100. Alternatively, a matching bolt may extend from a bow assembly, the top of a firearm, or on other such devices.

In one embodiment, the mounting platform 505 can be mounted to the stabilizer 100. The universal threading member 610 can be connected to cap head screw 135 or weight screw 165. The user can grasp the mounting stub 605 manually or with a tool to secure the mounting platform 505 to the stabilizer 100 if necessary.

Figure 7:
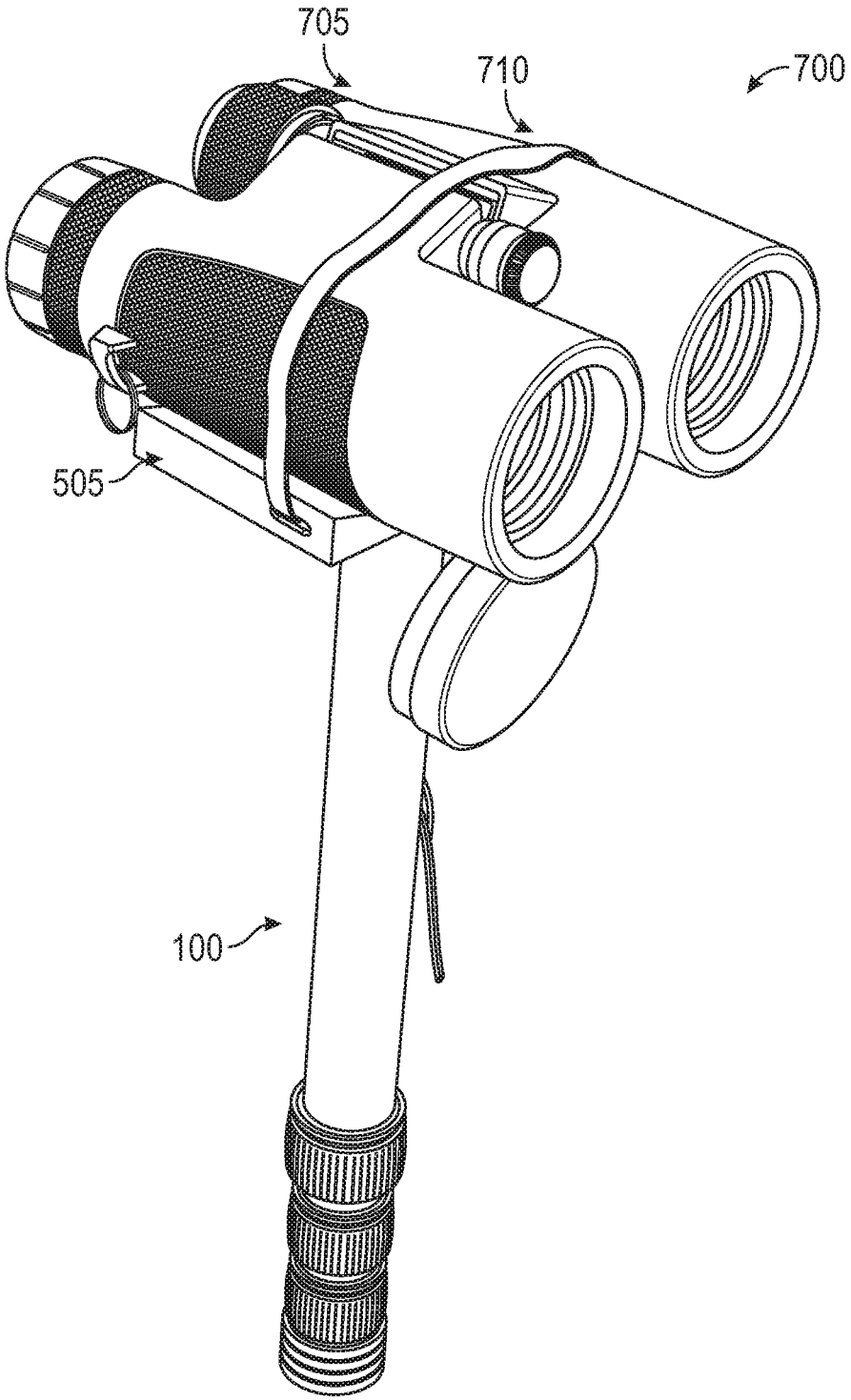
FIG. 7 illustrates an image of an optical platform attached to a stabilizer in accordance with an embodiment disclosed herein.

Once the mounting platform 505 is securely attached, an optical device 705, such as a pair of binoculars as shown in image 700 of FIG. 7, can be set in the side-by-side indentations 510 and 511 on the top of the mounting platform 505. The optical device can be secured to the mounting platform by feeding a strap 710, such as the strap of the optical device (or other strap), through the strap slots 525 and 526 and around the body of the mounting platform 505.

The strap 710 may be a ½" polyurethane webbing with a ladder buckle or any other type of durable strapping system. Alternatively, the strap associated with the optical device may be used. The strap 710 securely fastens a pair of binoculars to the mounting platform. The strap slots 525 and 526 are cut into the body of the assembly to allow a ½" (or other sized) webbing/strap to slide through.

The user can now use the stabilizer 100 and mounting platform 505 assembly to hold the mounted optical device while allowing the user to look through the optical device without the use of both of his/her hands which may be engaged in making calls, holding a bow, drawing a bow, or other such activities. The length of the stabilizer 100 can be adjusted as described above. The user may transport the optical device 705 as mounted or may disengage the optical device 705 from the mounting platform 505. The user may also quickly disengage the mounting platform 505 from the stabilizer 100 during transport if desired.

In another embodiment, where the mounting platform 505 is mounted to the top of a firearm, on a bow, or on another such device with a male threaded member, the user may be able to look through the optical device 705 while holding the weapon, making calls, etc. The user may transport the optical device 705 as mounted or may disengage the optical device 705 from the mounting platform 505. The user may also quickly disengage the mounting platform 505 from the male threaded member during transport if desired.

The mounting platform 505 is thus configured as a mountable platform for securely holding an optical device 705, wherein the mounting platform 505 includes one or more indentations 510 and 511 with cutouts 515 and 516 to reduce the weight of the mounting platform 505. At least one, and perhaps several strap slots 525 and 526 are provided on the exterior edges of the mounting platform 505. A mounting stub 605 is provided with a universal threading 610 which is used to connect the mounting platform 505 to a desired apparatus such as stabilizer 100.

Figure 8:
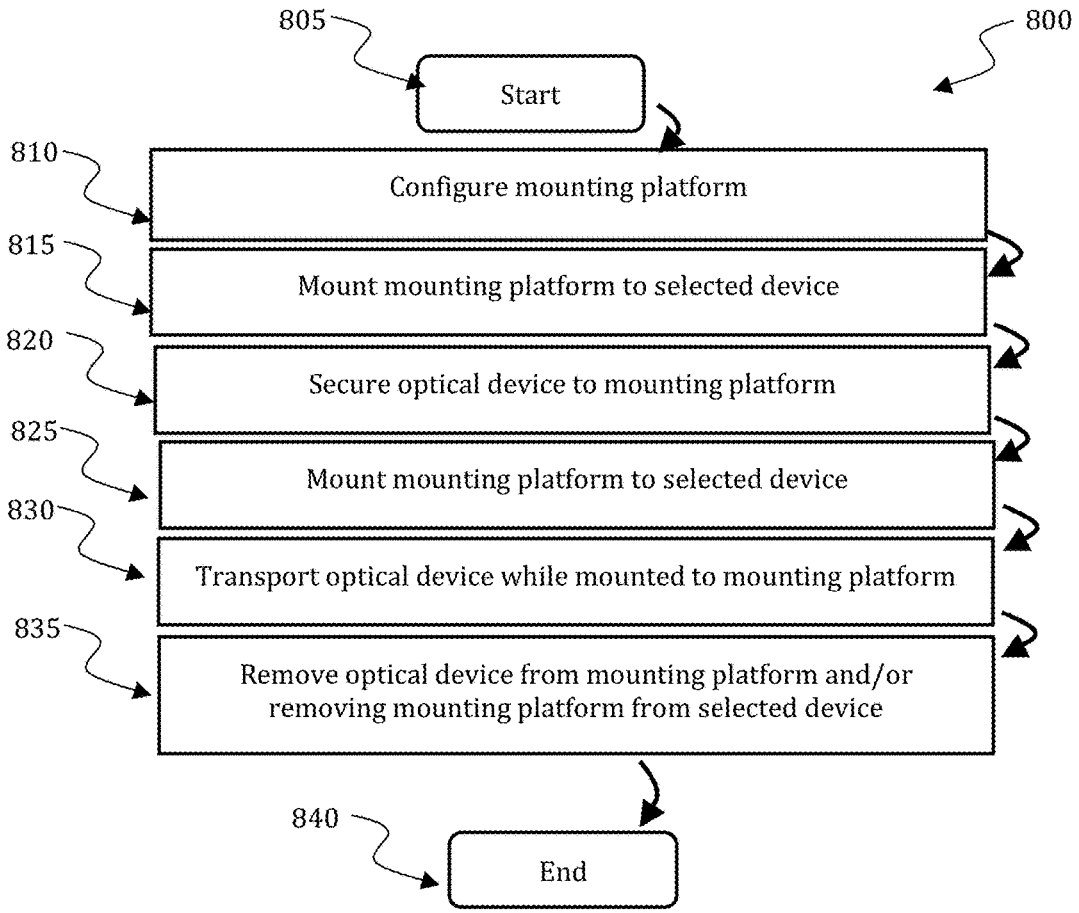
FIG. 8 illustrates a flow chart of steps associated with a method in accordance with an embodiment disclosed herein.

A set of steps associated with a method 800 for the use of a mounted optical device are illustrated in FIG. 8. The method begins at step 805. At step 810, a mounting platform can be configured to include one or more indentations, at least two strap loops, and a mounting stub with a universal threading.

At step 815, the mounting platform can be mounted to a desired apparatus. In a preferred embodiment, the mounting platform is mounted to a stabilizer, such as the stabilizer 100 associated with a bow. The optical apparatus may be secured to the mounting platform via straps fed through the strap slots and around the mounting platform as shown at step 820. It should be appreciated that in one embodiment, the user may install binoculars in the side-by-side indentations if desired. Thus user may then remove the binoculars, rotate the mounting platform, and install a single tube optical device in a single indentation running perpendicular to the two indentations.

The user may now use the optical device without having to hold the optical device with both hands as shown at step 825. This allows the user to manipulate his weapon, make calls, or make use of his hands in other ways, while the optical device remains stable and easy to look through. At step 830, the optical device may be transported while fixed to the mounting device. The user may, at his discretion, remove the optical device from the mounting platform and/or remove the mounting platform from the device on which it is mounted as illustrated at step 835. The method ends at step 840.

Various embodiments are disclosed herein. In some embodiments, the mounting platform 505 affixed to the stabilizer 100 may have a curved top portion. The indentations curvature provides a gentle cradle for an optical device. In some embodiments, a strap tightening device can be used to tightly hold the strap in place once it has been wrapped around the optical device and through the strap slots.

It should be appreciated that the mounting platform 505 can be constructed of high-density, hi-strength, matte finished Delrin, or other similar materials. In a preferred embodiment, the invention provides an easy to carry and extremely lightweight means for stabilizing an optical device. It is designed to be used with a stabilizer, such as the stabilizer 100, or to a firearm, bow, or other device. Together it provides a portable and adjustable viewing platform for bow hunters as well as for spectators at events which require the use of viewing optics.

The mounting platform 505 can be made to fit small, medium, and large framed binoculars. The user can set the binoculars on the mounting platform and then adjust the height of the platform to their eyes via the telescoping stabilizer 100. The optical device can then be secured with the strap.

Accordingly, the telescoping stabilizer 100 and mounting platform 505 described herein provides the following advantages: the stabilizer 100 provides an incremental adjustability that can be locked at any desired length and can be used as a stand at any desired height. The stabilizer 100 includes internal multi-directional stops that lock each tube in place, at the desired position, and prevent the tubes from sliding, twisting, or rotating. This improves the rigidity and solidness of the stabilizer 100 when it is used in conjunction with the mounting platform 505 for optical devices. The telescopic stabilizer 100 does not require the tubes themselves to rotate making the stabilizer more robust and less likely to fail in the field. The telescoping stabilizer 100 and mounting platform 505 are formed from lightweight materials such as Delrin and/or carbon fiber making them more durable, lighter weight, and rigid. The stabilizer 100 and mounting platform 505 arrangement also eliminates the need for the user to carry a traditional optical stabilization device and is therefore very convenient for use in the field. The telescoping stabilizer 100 is arranged such that the largest tube is attached to a bow riser, providing better strength near the point of attachment to the bow. In addition, the smaller diameter tubes extending away from the bow improve the wind profile of the stabilizer 100 giving it better wind deflection capability. The telescopic stabilizer 100 does not require the tubes themselves to rotate making the stabilizer 100 more robust and less likely to fail in the field. The disclosed embodiments further include a system that combines the needs of a hunting archer and a target archer. The use of multiple, small diameter, uni-directional, carbon fiber tubes gives the assembly an excellent strength to weight ratio. The assembly is very rigid despite its light weight. In addition, the multiple thin walled tubes connected via the multi-directional locking system contribute to the dampening/sound deadening of the stabilizer as well as to the feedback an archer receives when using the stabilizer.

Based on the foregoing, it can be appreciated that a number of embodiments, preferred and alternative, are disclosed herein. For example, in an embodiment, a stabilizer comprises at least two tubes, a first end cap comprising a fastening member formed on a proximal end of one of the at least two tubes wherein the end cap is formed to fixedly engage with a bow, a compression fitting for rigidly fixing the at least two tubes together, and a second end cap comprising a fastening member formed on a distal end of one of the at least two tubes wherein the second end cap is formed to fixedly engage with at least one weight.

In another embodiment, the at least two tubes are further configured such that each of the tubes has a decreasing diameter such that a next of the at least two tubes can be positioned inside a previous of the at least two tubes. The compression fitting further comprises: a locking collar, a compression knuckle, and a compression member inside the compression knuckle wherein the compression knuckle can be engaged with the locking collar thereby compressing the compression member.

In another embodiment, the stabilizer further comprises a mounting platform configured to fixedly engage with the first end cap. The mounting platform further comprises at least one indent formed in the mounting platform and at least one threaded mounting stub wherein the mounting stub is configured to fixedly attach to the first end cap.

In another embodiment, the mounting platform further comprises at least one cutout formed in the indent formed in the mounting platform and at least one strap slot formed through a rim of the mounting platform. In another embodiment, the mounting platform further comprises at least one strap wherein the strap is configured to hold an optical device on the mounting platform.

In another embodiment, the optical device comprises one of binoculars, a scope, a spotting scope, a telescope, and a range finder.

In another embodiment, a system for stabilization comprises at least two tubes, a first end cap comprising a fastening member formed on a proximal end of one of the at least two tubes wherein the end cap is formed to fixedly engage with a bow, a compression fitting for rigidly fixing the at least two tubes together, and a second end cap comprising a fastening member formed on a distal end of one of the at least two tubes wherein the second end cap is formed to fixedly engage with at least one weight.

In another embodiment of the system, the at least two tubes are further configured such that each of the tubes has a decreasing diameter such that a next of the at least two tubes can be positioned inside a previous of the at least two tubes. The compression fitting further comprises a locking collar, a compression knuckle, and a compression member inside the compression knuckle wherein the compression knuckle can be engaged with the locking collar thereby compressing the compression member.

In another embodiment, the system further comprises a mounting platform configured to fixedly engage with the first end cap. The mounting platform further comprises at least one indent formed in the mounting platform and at least one threaded mounting stub wherein the mounting stub is configured to fixedly attach to the first end cap.

In another embodiment, the mounting platform further comprises at least one cutout formed in the indent formed in the mounting platform and at least one strap slot formed through a rim of the mounting platform.

In another embodiment of the system, the mounting platform further comprises at least one strap wherein the strap is configured to hold an optical device on the mounting platform. The optical device comprises one of binoculars, a scope, a spotting scope, a telescope, and a range finder.

In another embodiment, a stabilization method comprises adjusting a length of a telescoping stabilizer; configuring a mounting platform: attaching the mounting platform to the telescoping stabilizer; mounting an optical device to the mounting platform; and viewing a scene through the optical device wherein the user is not required to manually hold or stabilize the optical device.

In an embodiment of the method, the optical device comprises one of binoculars, a scope, a spotting scope, a telescope, and a range finder.

It will be appreciated that variations of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims.

What is claimed is:

1. A stabilizer comprising:

at least two tubes;

a first end cap comprising a fastening member formed on a proximal end of one of said at least two tubes wherein said end cap is formed to fixedly engage with a bow;

a compression fitting for rigidly fixing said at least two tubes together;

a second end cap comprising a fastening member formed on a distal end of one of said at least two tubes wherein said second end cap is formed to fixedly engage with at least one weight; and a mounting platform configured to fixedly engage with said first end cap said mounting platform further comprising at least one strap slot formed through a rim of said mounting platform.

2. The stabilizer of claim 1 wherein said at least two tubes are further configured such that each of said tubes has a decreasing diameter such that a next of said at least two tubes can be positioned inside a previous of said at least two tubes.

3. The stabilizer of claim 1 wherein said compression fitting further comprises:

a locking collar;

a compression knuckle; and a compression member inside said compression knuckle wherein said compression knuckle can be engaged with said locking collar thereby compressing said compression member.

4. The stabilizer of claim 1 wherein said mounting platform further comprises:

at least one indent formed in said mounting platform; and at least one threaded mounting stub wherein said mounting stub is configured to fixedly attach to said first end cap.

5. The stabilizer of claim 1 wherein said mounting platform further comprises:

at least one cutout formed in said indent formed in said mounting platform.

6. The stabilizer of claim 1 wherein said mounting platform further comprises:

at least one strap wherein said strap is configured to hold an optical device on said mounting platform.

7. The stabilizer of claim 6 wherein said optical device comprises one of:

binoculars;

a scope;

a spotting scope;

a telescope; and a range finder.

8. A system for stabilization comprising:

at least two tubes;

a first end cap comprising a fastening member formed on a proximal end of one of said at least two tubes wherein said end cap is formed to fixedly engage with a bow;

a compression fitting for rigidly fixing said at least two tubes together;

a second end cap comprising a fastening member formed on a distal end of one of said at least two tubes wherein said second end cap is formed to fixedly engage with at least one weight; and a mounting platform configured to fixedly engage with said first end cap said mounting platform further comprising at least one strap slot formed through a rim of said mounting platform.

9. The system of claim 8 wherein said at least two tubes are further configured such that each of said tubes has a decreasing diameter such that a next of said at least two tubes can be positioned inside a previous of said at least two tubes.

10. The system of claim 8 wherein said compression fitting further comprises:

a locking collar;

a compression knuckle; and a compression member inside said compression knuckle wherein said compression knuckle can be engaged with said locking collar thereby compressing said compression member.

11. The system of claim 8 wherein said mounting platform further comprises:

at least one indent formed in said mounting platform; and at least one threaded mounting stub wherein said mounting stub is configured to fixedly attach to said first end cap.

12. The system of claim 8 wherein said mounting platform further comprises:

at least one cutout formed in said indent formed in said mounting platform.

13. The system of claim 8 wherein said mounting platform further comprises:

at least one strap wherein said strap is configured to hold an optical device on said mounting platform.

14. The system of claim 13 wherein said optical device comprises one of:

binoculars;

a scope;

a spotting scope;

a telescope; and a range finder.

* * * * *